US011339516B2

(12) United States Patent
Senel et al.

(10) Patent No.: US 11,339,516 B2
(45) Date of Patent: May 24, 2022

(54) DYED FABRIC FINISHING PROCESS

(71) Applicant: Sanko Tekstil Isletmeleri San. Ve Tic. A.S., Inegol-Bursa (TR)

(72) Inventors: Ece Senel, Inegol-Bursa (TR); Jitka Eryilmaz, Inegol-Bursa (TR); Deniz Iyidogan, Inegol-Bursa (TR); Nejdiye Gunes, Inegol-Bursa (TR); Zeynep Kardes, Inegol-Bursa (TR); Ozgur Cobanoglu, Inegol-Bursa (TR); Erdogan Baris Ozden, Inegol-Bursa (TR); Mahmut Ozdemir, Inegol-Bursa (TR)

(73) Assignee: Sanko Tekstil Isletmeleri San. Ve Tic. A.S., Inegol-Bursa (TR)

( * ) Notice: Subject to any disclaimer, the term of this patent is extended or adjusted under 35 U.S.C. 154(b) by 0 days.

(21) Appl. No.: 16/582,186

(22) Filed: Sep. 25, 2019

(65) Prior Publication Data

US 2020/0102680 A1 Apr. 2, 2020

(30) Foreign Application Priority Data

Sep. 27, 2018 (EP) ..... 18197107

(51) Int. Cl.

| | |
|---|---|
| ***D06B 11/00*** | (2006.01) |
| ***D06P 5/13*** | (2006.01) |
| ***D06P 5/15*** | (2006.01) |
| ***D06M 16/00*** | (2006.01) |

(52) U.S. Cl.

CPC ..... *D06B 11/0096* (2013.01); *D06M 16/00* (2013.01); *D06M 16/003* (2013.01); *D06P 5/137* (2013.01); *D06P 5/158* (2013.01)

(58) Field of Classification Search

None

See application file for complete search history.

(56) References Cited

U.S. PATENT DOCUMENTS

| | | | | | |
|---|---|---|---|---|---|
| 5,072,472 | A | * | 12/1991 | Enderlin | D06B 3/045 8/151.2 |
| 5,650,322 | A | | 7/1997 | Clarkson et al. | |
| 5,872,002 | A | * | 2/1999 | Sugiura | D06P 5/158 435/263 |
| 5,949,447 | A | * | 9/1999 | Arai | B41J 2/17553 347/23 |
| 6,015,707 | A | | 1/2000 | Emalfarb et al. | |

(Continued)

FOREIGN PATENT DOCUMENTS

| | | | | |
|---|---|---|---|---|
| EP | 0307564 | | 3/1989 | |
| EP | 3239373 | A1 * | 11/2017 | D06M 15/11 |
| GB | 2537144 | A * | 10/2016 | C12P 17/165 |

OTHER PUBLICATIONS

International Search Report issued by the EPO dated Nov. 6, 2019 for PCT/EP2019/076052.

(Continued)

*Primary Examiner* — Katie L. Hammer

(74) *Attorney, Agent, or Firm* — Silvia Salvadori

(57) ABSTRACT

The invention relates to a process of treating a dyed fabric, in which fungi are used. The invention also relates to a package comprising a water impervious container and a fabric or a garment treated according to the process, and to a fabric or a garment as obtainable by the process of the invention.

13 Claims, 2 Drawing Sheets

(56) References Cited

U.S. PATENT DOCUMENTS

Figure 1:
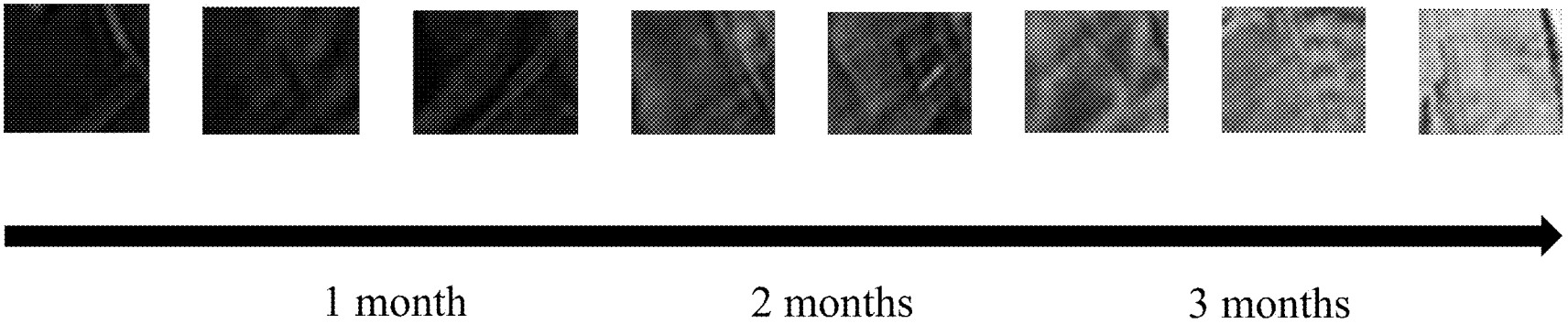

| | | | | |
|---|---|---|---|---|
| 2002/0164774 | A1 | 11/2002 | Fowler et al. | |
| 2005/0067347 | A1* | 3/2005 | Vanhulle | C02F 3/10 210/606 |

OTHER PUBLICATIONS

European Search Report issued by the EPO for EP priority application No. 18197107.8 dated Mar. 15, 2019.
European Search Report issued by the EPO for corrisponding EP application No. 19199835.09 dated Nov. 6, 2019.

* cited by examiner

DYED FABRIC FINISHING PROCESS

This Application is a U.S. Non-provisional application which claims priority to and the benefit of European Patent Application EP18197107.8 filed on 27 Sep. 2018, the content of which is incorporated herein by reference in its entirety.

FIELD OF THE INVENTION

The present invention relates to a process for the finishing of a dyed fabric. In particular, the present invention relates to a finishing process for a fabric, preferably a denim fabric, to impart to the fabric a worn or faded appearance, i.e. a "used" look, by using fungi. The invention also relates to a fabric and an article, e.g. a garment, obtained with said process. Thus, the present invention relates to a process for producing a fabric and an article including a fabric having a "used" or "worn" appearance. The process uses fungi to provide the required appearance of the fabric.

BACKGROUND OF THE INVENTION

Casual fabrics, especially denim, have enjoyed popularity in fashion industry and denim garments are extremely popular; a faded or worn look for denim fabrics is an important factor in the commercial value of a garment. As an example, a faded or worn look for blue jeans is desired by the customer. In the past, a worn look was obtained through wash and wear of the jeans; presently, the apparel industry is producing and selling jeans and garments with different wear patterns. The wear patterns have become part of the jeans style and fashion. Some examples of wear patterns include combs or honeycombs, whiskers, stacks, and train tracks.

These wear patterns are thus obtained in the finishing processes that can be applied to the fabric, preferably to the garment, in order to create different appearances and thus different visible effects on the front side of the fabric, i.e. on the surface that is visible when the article made by the fabric is worn. In fact, the success in apparel industry largely depends on creativity coming from a variety of fabric finishing processes that gives the fabric unique appearance and look.

A "used" or "vintage" or "worn-out" look of the fabric can be achieved by treating the fabric with a finishing process that is generally carried out on the garment or on the fabric. The known finishing processes may use mechanical abrasion, such as processes using stone-washing, acid wash, laser treatment and sandblasting. For example, in the stone washing, the fabric is washed in a cylinder in the presence of pumice stones that remove part of the yarn fibres including the dye present on said fibres during the washing step. Other finishing processes are e.g. chemicals (e.g., bleaching or oxidizing agents), ozone, enzymes and laser abrasion.

In this case, when a fabric and, in particular, an indigo ring-dyed woven fabric is used, wherein the indigo dye is located on the surface of the yarns leaving the core of the yarns undyed, a stone wash or sand blast or a laser abrasion process can be applied to allow varying amounts of the undyed cores of the indigo yarns to become visible. All the above mentioned finishing treatments allow to obtain different visible effects, in particular worn appearance, which makes the fabric fashionable in the apparel, clothing and textile industries.

However, the visible effects and appearances that can be obtained by the known finishing treatments are limited. For example, in a finished fabric, the worn appearance, is essentially due to the amounts of the non-dyed cores of the indigo yarns made visible; therefore, the difference between one product having worn appearance and another one is the overall "colour shade" of the product, i.e. how much a product having worn appearance is faded with respect to the other product. In a laser abrasion process, the software running the laser beam will inevitably reproduce the same pattern on all treated garments.

Another problem is the fact that it is difficult to control the degree of removal of dye from the fabric during the known finishing process; conventional abrasion-based methods, generally, significantly decrease the mechanical integrity of the fabric, hence lowering tensile strength of treated fabrics and garments. Therefore, clothing articles made by different producers with identical finishing processes eventually result to be very similar one to another, thus reducing the commercial desirability of the product and the possibility to distinguish a product from those of another producer.

JP 2001073280 discloses a process to change the colour of an indigo-dyed product (for example blue denim and blue jeans) from indigo to a sepia colour tone, comprising a step of contacting the indigo-dyed product with a preparation obtained from Basidiomycetes fungi in the presence of water. The fungi used in this document are mainly in the form of the waste parts of agricultural micorrhizal mushrooms, in the form of a dry composition. Additionally, see claim 5 of JP'280, the decolorization process occurs in presence of hydrogen peroxide and results in an uniform sepia colour.

SUMMARY OF THE INVENTION

It is an aim of the present invention to solve the above mentioned problems and to provide a finishing process for the production of a fabric having an improved worn, or faded, appearance, in particular a distinctive worn appearance by tuning the colour into a variety of shades. Another aim of the present invention, is to provide a process for the production of a fabric having a worn-out appearance which is commercially desirable, recognizable and readily distinguishable from other products.

These and other aims are achieved by a process of treating a dyed fabric to remove part of the dye and provide different shades of colour. Another object of the invention is a fabric or a garment. The garment, or the fabric, including the fungi composition, may be packaged in a container in which incubation is carried out at least in part. An object of the invention is therefore a package.

In a preferred embodiment, the incubation of the fabric is carried out on a garment. The garment in a suitable container may be present in a shop, i.e. the incubation may carried out at least in part at a location different from the garment manufacturing premises, such as e.g. a retailer shop. In an embodiment, the garment may be inspected and eventually bought by a customer when the digestion of the dye has provided the shades of colour required by the customer.

A preferred dye is indigo. Preferably, the yarns dyed with indigo are indigo ring-dyed, i.e. the indigo is present on the outer surface of the yarn. In an embodiment, the fabric comprises more than one dye. According to embodiments, the dyed fabric may comprise a sulphur dye; for example, a dyed (e.g., indigo-dyed) fabric may be overdyed with a sulphur dye. According to embodiments, a dyed fabric may be a sulphur-dyed fabric overdyed with at least another dye, e.g., indigo. Sulphur dyes are known in the art and commercially available.

In the following description, reference is made to the process being carried out on a fabric; this definition includes the fabric present in an article, especially a garment or clothing article. In other words, process claims are directed to a process that is carried out on a fabric independently on the form of the fabric. An article or apparel, e.g. a garment, that comprises or that is made with the said fabric is included in the scope of protection of the claims of this application.

The process of treating a dyed fabric according to the invention, said fabric containing at least one dye, provides to remove different amounts of dye from different areas of said fabric, thus providing different colour shades to said fabric, and it is characterized in comprising the steps of:

i) selecting a fabric including at least one dye;
ii) preparing a composition containing living fungi microorganisms apt to digest said at least one dye;
iii) applying said composition to the at least one area of said dyed fabric;
iv) incubating said fungi microorganisms on said fabric;
v) removing said fungi from said fabric once the required colour shades have been obtained.

In an embodiment, the selected area corresponds to the entire fabric or garment. In an embodiment, the composition and/or the fabric contains water in step iii) and the fabric is maintained in a humid condition during incubation step iv). According to embodiments, the dye is selected from indigo, indigo derivatives, sulphur dyes, azo dyes and mixture thereof. Suitable azo dyes are, for example, Reactive Orange, Congo Red, Reactive Black 5, Direct Blue 71 and mixture thereof. Preferably, the dye of the fabric is or contains indigo or an indigo derivative dye, or a mixture thereof. In an embodiment, the composition includes a supporting medium, or growing medium, for fungi.

According to an embodiment, the process further comprises the steps of: memorizing a plurality of the colour shades of said dyed fabric as obtainable at different times of incubation; memorizing the incubation times required to obtain said colour shades; providing a chart of colour shades and corresponding incubation times; selecting one of the memorized shades; incubating the said fabric including said fungi microorganisms for the time corresponding to the selected shade.

In an embodiment, the process includes the steps of memorizing different shades obtainable by using different growing mediums and/or different fungi; in such a case, the chart of colour shades includes different shades according to different mediums and/or different fungi. Fungi that are suitable to be used in the process of the invention are commercially available or may be obtained from known microorganisms culture collections. For example, suitable fungi for treating dyed fabrics, e.g., indigo dyed fabrics are fungi selected from white rot fungi, preferably *Acremonium, Gymnoascus, Penicillum, Funalia, Trametes* or mixtures thereof. According to embodiments, fungi are selected from *Acremonium camptosporum, Gymnoascus arxii, Penicillium chrysogenum, Funalia trogii, Trametes hirsuta*, or mixtures thereof. According to embodiments, fungi microorganisms may be genetically modified in order to digest a dye and/or pigment which is not digested by the same fungus when it is not genetically modified (i.e., when it is a wild type fungus). According to embodiments, the composition may contain a mixture of two or more different fungi, so that the two or more different fungi are provided and cultured together (i.e., as a co-culture) on the dyed fabric. In this case, a plurality of dyes on the fabric may be digested substantially at the same time. As used herein, the term "co-culture" refers to the substantially simultaneous culturing of at least two different fungi microorganisms on the dyed fabric. Advantageously, different fungi can be provided together on the dyed fabric and co-cultured to provide the fabric with different visual effects. According to embodiments, different fungi produce different enzymes, i.e., different types and/or amount of enzymes. A further advantage of the present invention is that, using a combination of different fungi, the dyed fabric can be provided with different combinations of enzymes, so that a great variety of visual effects can be provided to the fabric. Advantageously, *Acremonium, Gymnoascus, Penicillum, Funalia* and *Trametes* fungi are classified as BSL-1 (Biosafety level-1), i.e., as not dangerous and hazardous to humans. According to embodiments, the incubation temperature ranges from 15° C. to 40° C., preferably from 20° C. to 35° C. According to embodiments, the duration of incubation step may be one month or more, two months or more, or three months or more. According to embodiments, by increasing the length of the incubation of the dyed fabric with a selected composition, a lighter shade of colour may be obtained.

As previously mentioned, the fabric, i.e., the dyed fabric, is preferably part of a garment or apparel; the fungi composition is applied to said garment, and, according to embodiments, the process further comprises the step of packaging the garment including the composition in a container to maintain the garment in a humid condition during incubation. In an embodiment, the incubation step of said garment in said container is carried out at least in part in any of a facility of the producer, a warehouse or a shop or any combination thereof.

In embodiments, the package comprises a water impervious container suitable to maintain the conditions required for the fungi incubation and the garment or fabric (i.e., dyed fabric) contained in the container includes a composition comprising living fungi. In an embodiment, the final step of fungi removal, is carried out by the final user; fungi removal may be carried out by simply washing said garment in a washing machine with a common washing machine detergent.

The invention provides distinctive advantages over the prior art. The final result of the process of the invention is a fabric or a garment wherein the dye has been digested in different amounts in different areas of the fabric; thus said fabric is provided with different amounts of dye in different areas to provide the required colour shades.

Another advantage is that in the fabric or garment treated according to the invention the fungi digest the dye, leaving the fibers of the yarn undigested. Thus, in a garment as obtainable through the invention process, the fabric includes yarns that are integer or substantially integer, contrary to known finishing processes wherein the external fibers of the yarns, especially cotton yarns, are no longer present in the side of the yarn that has been subjected to abrasion or enzyme digestion. According to embodiments, a fabric or garment as obtainable by the process of the invention includes cotton yarns, wherein the cotton fibres of said cotton yarns are substantially integer. According to embodiments, the fabric may also contain synthetic yarns, e.g., polyester yarns, and/or blended yarns, i.e., yarns comprising both natural (e.g., cotton) and synthetic fibers. According to embodiments, said synthetic yarns and/or said synthetic fibres may have different elasticity properties. Advantageously, when fabrics or garments comprising synthetic yarns and/or blended yarns are treated according to the process of the invention, fungi digest dye molecules on yarns and fibers substantially without damaging the yarns and fibers. Conversely, currently available treatments with cellulase enzymes (i.e., isolated cellulase enzymes) do not provide visual effects to dyed synthetic yarns (e.g., polyester) and/or blended yarns (e.g., blended yarns including cotton fibers and polyester fibers) that may be present in fabric and garments to be treated. Moreover, visual effects are currently provided to dyed synthetic yarns and/or blended yarns using stones during washing (i.e., by washing the yarns, fabrics or garments, in presence of stones, such as pumice stones). However, washing, for example, a fabric, in presence of stones, may damage the yarns of the fabric, thus reducing the fabric strength. Advantageously, through the process of the invention, at least part of the dye on synthetic yarns and/or blended yarns can be removed, to provide fading and/or worn out look, leaving yarns integer or substantially integer, so that fabric and/or garment strength is not jeopardized. In view of this and others advantageous aspects, the process of the invention results to be particularly suitable to impart a worn-out and/or faded look to synthetic and/or blended yarns containing fabrics and/or garments, i.e., to fabrics and/or garments including any amount of synthetic and/or blended fibers or yarns, up to 100% by weight of the fabric. For example, in denim fabrics, synthetic and/or blended fibers or yarns may be present in an amount in the range of from 40% to 45% by weight of the fabric. Known finishing treatments, including dry mechanical process (scraping, whiskering, rubbing, crimping, laser treatments, etc.) and/or wet chemical washing (bleaching, enzyme wash, e.g., cellulase wash, stone/enzyme wash, acid wash etc.), may be used to provide visual effects to fabrics comprising regenerated fibers (i.e., regenerated cellulose fibers such as, for example, viscose rayon). However, it has been observed that such known finishing treatments jeopardize mechanical strength of such fabrics. For example, it has been observed that mechanical strength of regenerated fibers (e.g., rayon fibers) is more affected by known finishing treatments than natural fibers (e.g., natural cotton). The process of the present invention is particularly suitable to treat fabrics comprising regenerated fibers (e.g., yarns comprising regenerated fibers or a blend of regenerated fibers and natural and/or synthetic fibers). Regenerated fibers are obtained by dissolving natural cellulose in chemicals and working it into fibers again. According to embodiments, the fabric may comprise regenerated yarns or fibers, and/or blended yarns, i.e., yarns comprising regenerated fibers and natural fibers (e.g., cotton) and/or synthetic fibers. For example, suitable regenerated fibers can be selected from rayon, lyocell, modal, viscose, bamboo, and mixture thereof. According to embodiments, the fabric may be a woven fabric, a knitted fabric or a non-woven fabric. Preferably, the fabric is a woven fabric, more preferably a denim fabric.

An advantage of the invention is that while growing on a substrate, fungi are secreting some enzymes, such as laccase, peroxidase, manganese peroxidase and cellulase, outside of the cell. Without being bound to a specific scientific explanation, it has been observed that the composition of these secretions is determined by microorganism's metabolic requirements and change due to the cells physiology-metabolism, as well as to the medium components in the growth medium used during the incubation of the fungi with the fabric; the fungus secretions (mainly its compositions-different enzyme amounts etc.) change during growing and degrading dye molecules changes correspondingly, due to the metabolism of the fungi. Without being bound to a specific scientific explanation, it has been observed that living fungi suitable to be used in the process of the invention may or may not secrete enzymes that digest natural, e.g., cotton, fibers (e.g., cellulase). Moreover, it has been observed that, even if living fungi secrete, among others, cellulase enzymes on the fabric surface, such cellulase enzymes are in a small amount, so that cotton yarns in the fabric would remain integer or substantially integer, contrary to known finishing processes wherein the external fibers of the yarns, especially cotton yarns, are no longer present in the side of the yarn that has been subjected to abrasion (e.g., using pumice stones) or enzyme digestion (i.e., digestion using isolated enzymes). In general, enzymes used in industrial washes are, usually, isolated cellulase enzymes, which target cellulose molecules in cotton yarns, substantially removing external dyed fibers of the yarns, to create worn-out look. Conversely, it has been observed that living fungi microorganisms used in the process of the invention naturally produce different enzymes that are secreted onto the fabric. The production and secretion of such different enzymes results in the degradation of dyes/pigments. As above mentioned, when fungi provided to the garment release cellulases, cellulases are in a strongly reduced amount with respect to the amount of cellulases (i.e., isolated cellulases) used according to currently available treatments, e.g., enzyme washes with cellulases. According to embodiments, the duration of incubation step may be adjusted by varying the composition of the growth medium and/or the amount of fungi applied to the fabric. For instance by selecting a predetermined amount of nutrients (such as C- and/or N-containing ingredients) to be included in the medium, as well as a predetermined amount of fungi (e.g., fungi spores), incubation time may be reduced.

Without being bound to a specific scientific explanation, a possible explanation is that the required enzymes are secreted onto the fabric surface to degrade dye molecules during early stages of the incubation. Also, it has been observed that, advantageously, fungi may use metabolites produced during the incubation step as nutrients, so that fungi can survive even if a small amount of nutrients is included into the growth medium. Additionally, advantageously, the growth of the fungi on the fabric, or garment, is not uniform throughout the fabric. This results in colour changes on fabric surface, namely in many different shades of colour, that are non-homogenous and visually seems as natural colour gradients or transitions such as those obtainable from natural wear and use of the garment.

DETAILED DESCRIPTION

Figure 2:
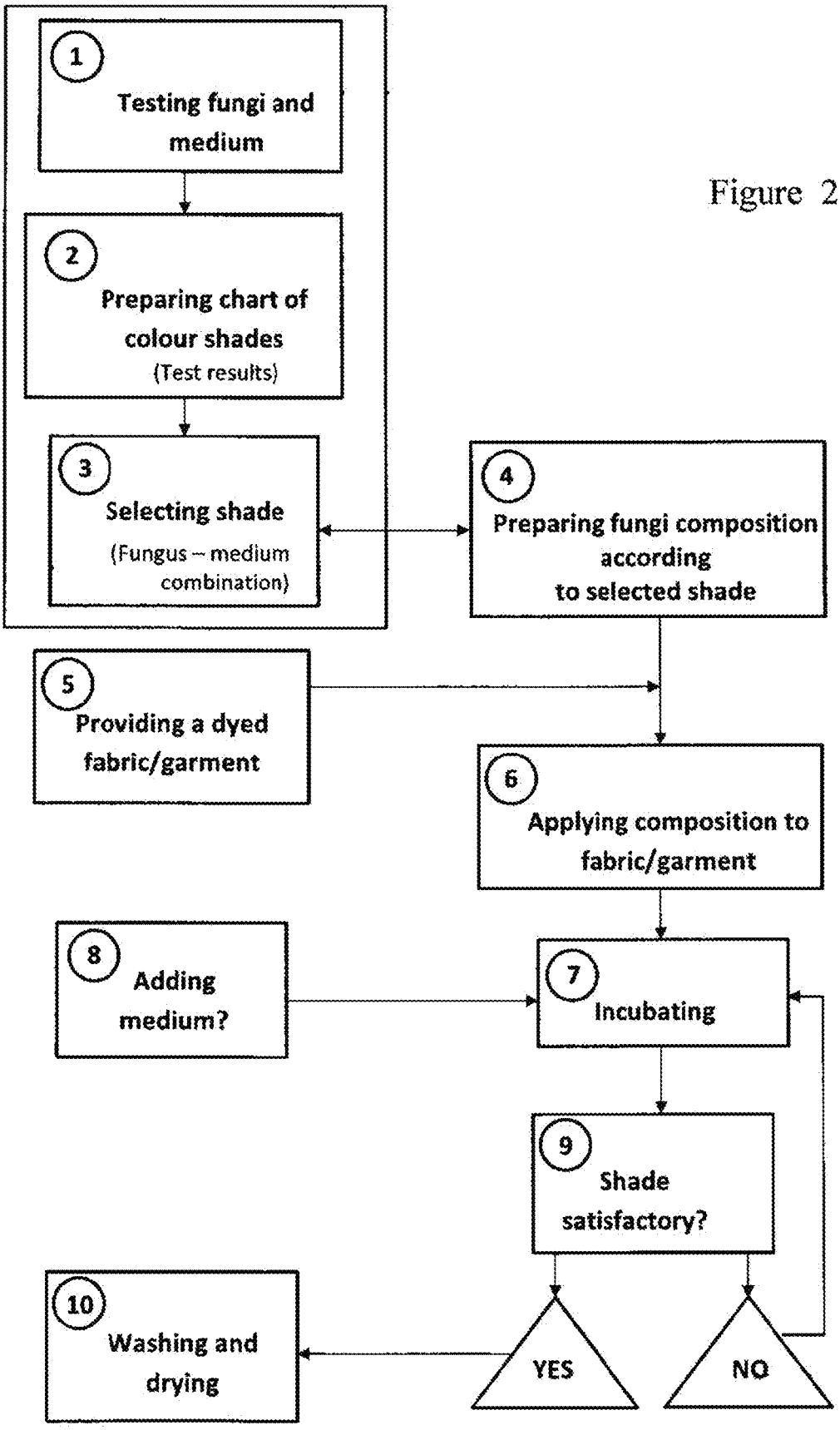

The invention will now be further disclosed with reference to the enclosed drawings, which have to be interpreted as illustrative and non-limiting schematic representations of exemplary embodiments of the present invention, in which:

FIG. 1 shows the different shades obtained by incubating for different periods a fabric treated with a fungi composition; and FIG. 2 is a flow chart showing the steps of an exemplary embodiment of the process according to the invention.

Referring initially to the flow chart of FIG. 2, such flow chart relates to an exemplary embodiment of the process of the invention, comprising the following steps.

In step 1, testing of fungi and medium combinations, is carried out in order to evaluate the colour fading effect of such combinations. Each suitable microorganism is tested on dyed fabric in different compositions containing different growth, or supporting, mediums; the fading effect of the fungi on the dyed fabric is also monitored and detected at different incubation times. This activity is part of the preliminary steps of the process, and is not seen as a step that has to be necessarily repeated every time, since its aim is to determine the efficacy of such combinations of fungi and media. The results of the testing activities are memorized in suitable memory means; in other words, step 1 includes memorizing a plurality of colour shades of a dyed fabric as obtainable by using at least one fungus in a medium at different times of incubation, and memorizing the incubation times required to obtain said colour shades.

In step 2, the results of the first step 1 testing activity are organized in a chart, which provides information about colour shades and, for example, corresponding incubation times, for at least one fungus. In this way, advantageously, the effects of the different fungus-medium combinations can be easily compared to one another, and to the starting shade of the fabric (e.g., a woven fabric, preferably a denim fabric), so that choosing which combination(s) to use is easy and clear. Advantageously, the chart may be in any format and the information may be provided in any suitable way, e.g. by photos or digitally, by figures expressing the colour intensity. Additionally, the chart may be a sample catalogue including samples of fabrics having different colour shades, each shade being obtainable through, for example, a specific combination of fungus, incubation time and medium. Advantageously, different charts may be provided for different kind of fabrics/garments; for example, different charts may be provided for fabrics which are dyed with different shades of colour before the treatment with fungi, according to the invention. Accordingly, successive step 3 comprises selecting a shade of colour, e.g. from those shown in the table generated in step 2. Each shade of colour refers to at least one of the combinations of fungus and medium and incubation time. According to embodiments, this step 3 of selecting a shade of colour may be carried out by a customer, including the final customer in a shop.

According to the embodiment of FIG. 2, the process then continues (step 4) with the preparation of a suitable composition incorporating the fungus-medium combination that has been selected in step 3, with which composition the fabric/garment will undergo its incubating step. In step 5, a dyed fabric/garment (e.g., an indigo dyed fabric/garment) is provided. The fabric or garment is suitable to provide the required shades when incubated with the composition prepared in step 4. In other words, according to embodiments, the fabric or garment (or other textile article) to be treated with the fungus composition, is selected according to the tests previously carried out: for example, the type and content of dye in the fabric may be such that, when treated with the selected fungus and medium for the selected incubation time, the resulting shade substantially corresponds to the colour shade in the chart. With step 6 the composition prepared in step 4 is applied to the fabric/garment provided in step 5. The composition may be applied to the fabric or garment through known methods.

In step 7 of FIG. 2, the fabric/garment that has been provided with the desired fungi composition (according to step 6), is incubated, preferably at a temperature ranging from 20° C. to 35° C. This allows the fungi to carry their colour fading effects on the fabric/garment that is being incubated. As mentioned, incubation is carried out in suitable conditions, which means that the fabric/garment may be added with water before adding the composition, and that the composition itself may contain water and/or suitable additives to maintain the fabric in a humid condition throughout the incubation step 7. To this regard, it is advantageous to provide the fabric, or garment, with a container that is water impervious or in any case suitable to maintain the required humidity and water content in the fabric/garment during incubation step 7. Additional medium and/or fungi (chosen in above discussed step 3) may be added (according to optional step 8 of FIG. 2) to the fabric during the incubation started in step 7. This addition might be necessary in some cases, e.g. when there has been an unexpected decrease in the fungi population during the incubation process, or the incubation process must be carried out for a longer time than expected, and thus the fungi might need additional growth medium in order to continue their colour fading effect.

Step 9 may be an optional step; in step 9 the status of the fabric (or garment) undergoing the incubation step 7 is evaluated to assess if the fading effect has reached the required level, i.e., if the shade of colour of the fabric is satisfactory, e.g., to a final customer.

If the shade is not satisfactory (option "NO" according to FIG. 2), the incubation step 7 will proceed, with the addition of medium and/or fungi, according to step 8, if needed. If the shade is deemed satisfactory (option "YES" according to FIG. 2), the fungi composition is removed from the fabric (step 10 according to FIG. 2), and then the fabric is dried. According to embodiments, removal is carried out by washing the fabric. For example, washing might be done through hot cylinders, in presence of pressure, to remove fungi, by the fabric manufacturer or by the final producer, before selling the final product, e.g., the treated garment having the selected colour shade, to the final customer. In other words, according to embodiments, washing may be performed by the fabric producer, or when said fabric is part of a garment, by any of the garment producer, the garment seller or the final customer, i.e., the final user. Advantageously, the washing type and/or the washing conditions may be decided by the customer. According to embodiments, the fungi may be removed in a simple home washing; in this way, advantageously, the removal process could be carried out in an inexpensive way, by the fabric manufacturer or, possibly, by the final customer, i.e., through home washing of the treated garment.

As above mentioned, a chart, providing information about colour shades and, for example, corresponding incubation times, for at least one fungus, may be obtained in step 2 of the exemplary embodiment of the process of the invention, above disclosed with reference to FIG. 2. According to embodiments, the chart may compare the fading effects given to a same starting product, e.g. an indigo dyed fabric, by different fungus-medium combinations after a certain incubation period, e.g., a 40-days incubation period. According to embodiments, the chart may show multiple fungus-medium combinations. For example, an exemplary chart may show five different genera of fungi (e.g., *Trametes, Funalia, Acremonium, Gymnoascus, Penicillium*), paired with four different support media (Potato Dextrose Broth "PDB" medium, malt extract medium, mineral medium, enriched mineral medium), for a total of 20 combinations.

Advantageously, according to embodiments, the chart may also show the effects of incubating, e.g., an indigo-dyed denim, in the medium only, as well as a non-treated control sample and a sample where the denim is incubated in water only. In this way, advantageously, it is possible to evaluate the possibility that the medium by itself might have a colour fading effect. Advantageously, according to embodiments, the incubation of the fabric with different medium-fungus combinations may provide for different colour shades and/or fading effects.

Advantageous technical effects of using fungi, according to the process of the invention, have been observed. In fact, it has been observed that the samples of fabric that were incubated without fungi, i.e. the ones where only water or the medium by itself have been used, show no discolouration when compared to the control sample not subjected to the process. Moreover, it has been observed that the distribution of the colour fading effect may be, advantageously, non-homogeneous in the fabric; for example, specific fungus-medium combinations (e.g. *Gymnoascus*-mineral medium, or *Funalia*-malt extract medium) may provide for a fading effect which is particularly non-homogeneous throughout the fabric. This gives a more natural look to the denim. Different tables can be prepared with reference to different incubation periods and/or different fungus-medium combinations.

FIG. 1 provides an example of multiple shades obtained after different incubation periods in the same fungus-medium combination. FIG. 1 shows the results of applying the process of the invention, which may be carried out, according to embodiments, directly to a garment, for example blue jeans. The fabric samples have been ordered in FIG. 1 in a way where the ones to the left have been subjected to a shorter incubation period, while the ones to the right have been subjected to increasingly longer periods of incubation (as indicated by the arrow). As shown in FIG. 1, a longer incubation period (e.g., three months with respect to one or two months) results in a lighter shade of colour of the fabric, e.g., denim fabric. As previously discussed, the process can be used directly on a garment, instead of only a fabric sample. Advantageously, when the process according to the invention is carried out on a garment, the colour fading effect obtained is particularly is non-homogeneous, giving the garment a more natural faded look.

Finally, it is noticed that the invention also provides the possibility of slowing the finishing process. The treated fabric, e.g. in a package, might be kept at a temperature lower than the above discussed incubation temperatures, of about e.g. 15-19° C., to slow the growth process, the temperature colder which will effect on digestion duration. If the seller wants to keep the package for a long time in the shop/company before sell it, during application of microorganisms to the fabric, less amount of medium might be provided to slow down the growth process and, therefore, the dye digestion process.

The invention claimed is:

1. A process of treating a dyed fabric, said fabric containing at least one dye, by removing different amounts of dye from different areas of said fabric and providing different colour shades to said fabric, characterized in comprising the steps of:

i) selecting a fabric including at least one dye;

ii) preparing a composition containing living fungi microorganisms apt to digest said at least one dye;

iii) applying said composition to at least one area of said dyed fabric;

iv) incubating said fungi microorganisms on said fabric, whereby said fungi microorganisms grow in a non-uniform way throughout said fabric to digest said dye and provide different shades of colour;

v) removing said fungi from said fabric once the required colour shades have been obtained.

2. A process according to claim 1, wherein said composition and/or said fabric contains water in step iii) and said fabric is maintained in a humid condition during step iv).

3. A process according to claim 1, wherein said dye is selected from indigo, an indigo derivative or mixtures thereof.

4. A process according to claim 1, wherein said composition includes a growing medium.

5. A process according to claim 1 further comprising the steps of: memorizing a plurality of the colour shades of said dyed fabric as obtainable by at least one fungus at different times of incubation; memorizing the incubation times required to obtain said colour shades; providing a chart of colour shades and corresponding incubation times; selecting one of the memorized shades; incubating the said fabric including said fungi microorganisms for the time corresponding to the selected shade.

6. A process according to claim 4, further comprising the steps of: producing a plurality of different colour shades obtainable by using different fungi and/or different growing mediums or mediums amounts, memorizing said different colour shades and preparing a chart showing said different colour shades wherein said chart of colour shades includes different shades according to different mediums.

7. A process according to claim 1, wherein said fungi are selected from white rot fungi.

8. A process according to claim 1, wherein said fungi composition is applied to said fabric, and further comprising the step of packaging the fabric including the composition in a container to maintain the fabric in a humid condition during incubation.

9. A process according to claim 8, wherein said incubation of said fabric in said container is carried out in any of a facility of the producer, a warehouse or a shop.

10. A process according to claim 1, wherein said fabric is in the form or is part of a garment or apparel.

11. A process according to claim 1, wherein step v) is carried out by the fabric producer or, when said fabric is part of a garment, by any of the garment producer, the garment seller or the final user or consumer, by washing said garment.

12. A process according to claim 11, wherein said step v) is carried out by said final user by home washing. a container to maintain the fabric in a humid condition during incubation.

13. The process according to claim 7, wherein said white rot fungi are selected from *Acremonium, Gymnoascus*, Penicillum, *Funalia, Trametes* and mixtures thereof.

* * * * *